US010396470B1

(12) United States Patent
Rashidian

(10) Patent No.: US 10,396,470 B1
(45) Date of Patent: Aug. 27, 2019

(54) WIRELESS SYSTEM ARCHITECTURE WITH DEPENDENT SUPERSTRATE FOR MILLIMETER-WAVE PHASED-ARRAY ANTENNAS

(71) Applicant: PERASO TECHNOLOGIES INC., Toronto (CA)

(72) Inventor: Atabak Rashidian, North York (CA)

(73) Assignee: Peraso Technologies Inc., Toronto (CA)

( * ) Notice: Subject to any disclaimer, the term of this patent is extended or adjusted under 35 U.S.C. 154(b) by 0 days.

(21) Appl. No.: 15/923,680

(22) Filed: Mar. 16, 2018

(51) Int. Cl.

| | |
|---|---|
| ***H01Q 1/24*** | (2006.01) |
| ***H01Q 21/22*** | (2006.01) |
| ***H01Q 21/06*** | (2006.01) |
| ***H01Q 1/38*** | (2006.01) |
| ***H01Q 1/48*** | (2006.01) |

(52) U.S. Cl.
CPC ..... *H01Q 21/22* (2013.01); *H01Q 1/38* (2013.01); *H01Q 1/48* (2013.01); *H01Q 21/065* (2013.01)

(58) Field of Classification Search
CPC ..... H01Q 21/22; H01Q 1/38; H01Q 1/48; H01Q 21/065
See application file for complete search history.

(56) References Cited

U.S. PATENT DOCUMENTS

| | | | | |
|---|---|---|---|---|
| 2016/0308563 | A1* | 10/2016 | Ouyang | H04B 1/1081 |
| 2017/0338563 | A1* | 11/2017 | Gu | H01Q 9/0407 |
| 2018/0205155 | A1* | 7/2018 | Mizunuma | H01L 25/00 |
| 2018/0219587 | A1* | 8/2018 | Huo | H04B 1/40 |
| 2019/0027802 | A1* | 1/2019 | Noori | H01P 3/081 |

* cited by examiner

*Primary Examiner* — Dameon E Levi
*Assistant Examiner* — David E Lotter
(74) *Attorney, Agent, or Firm* — Perry + Currier Inc.

(57) ABSTRACT

A wireless communications assembly includes: a primary board including: (i) an upper surface bearing a radio controller, and defining a set of control contacts for connection to respective ports of the radio controller; (ii) a lower surface opposite the upper surface, the lower surface defining a plurality of antenna contacts; (iii) a plurality of conduits extending through the primary board from the antenna contacts to the control contacts; and (iv) an antenna ground plane; a superstrate board including: (i) an inner surface facing the lower surface of the primary board; (ii) an outer surface opposite the inner surface; (iii) a phased array of antenna elements disposed on the inner surface; and a surface-mount package between the lower surface and the inner surface for connecting a subset of the antenna contacts directly to the antenna elements and to provide a substrate between the antenna elements and the antenna ground layer.

12 Claims, 6 Drawing Sheets

WIRELESS SYSTEM ARCHITECTURE WITH DEPENDENT SUPERSTRATE FOR MILLIMETER-WAVE PHASED-ARRAY ANTENNAS

FIELD

The specification relates generally to wireless communications, and specifically to a wireless communications assembly with a dependent superstrate antenna.

BACKGROUND

The performance of wireless antenna elements (e.g. printed antenna elements) is dependent, in part, on the precision of antenna geometry and on the characteristics of the antenna substrate—the material between the antenna elements and the ground layer; which is typically a dielectric material supporting the antenna elements. Certain substrate materials, as well as assembly configurations, have superior performance characteristics to others, but may also be costlier to fabricate, have larger physical footprints, and the like.

SUMMARY

An aspect of the specification provides a wireless communications assembly including: a primary board including: (i) an upper surface bearing a radio controller, and defining a set of control contacts for connection to respective ports of the radio controller; (ii) a lower surface opposite the upper surface, the lower surface defining a plurality of antenna contacts; (iii) a plurality of conduits extending through the primary board from the antenna contacts to the control contacts; and (iv) an antenna ground plane; a superstrate board including: (i) an inner surface facing the lower surface of the primary board; (ii) an outer surface opposite the inner surface; (iii) a phased array of antenna elements disposed on the inner surface; and a surface-mount package between the lower surface and the inner surface for connecting a subset of the antenna contacts directly to the antenna elements and to provide a substrate between the antenna elements and the antenna ground layer.

BRIEF DESCRIPTIONS OF THE DRAWINGS

Embodiments are described with reference to the following figures, in which.

DETAILED DESCRIPTION

Figure 1A:
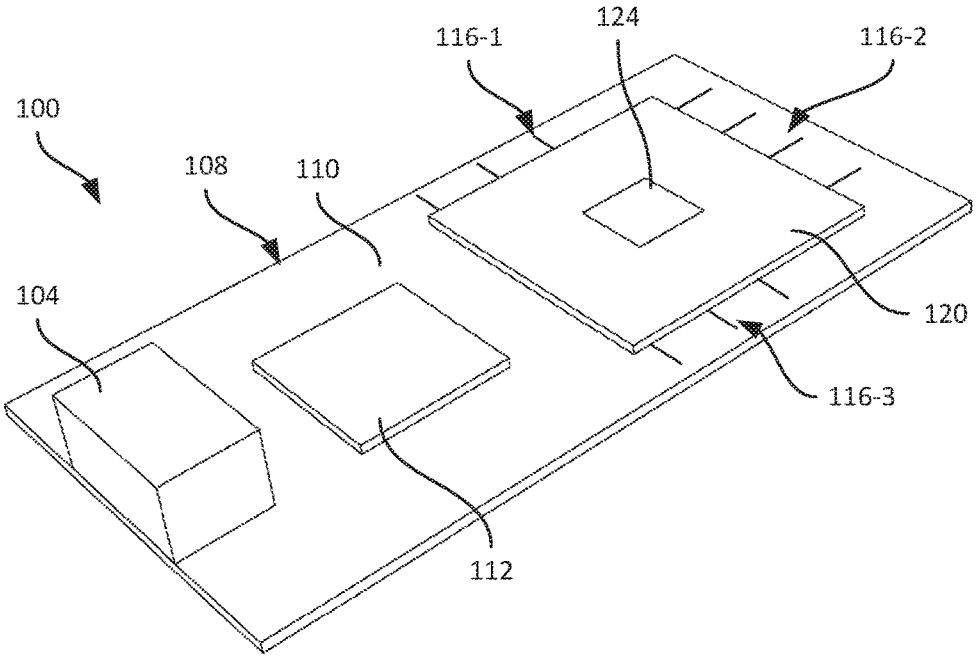
FIGS. 1A and 1B depict perspective views of a communications assembly.

FIG. 1A depicts an example wireless communications assembly 100 (also referred to simply as the assembly 100 herein) in accordance with the teachings of this disclosure. The assembly 100, in general, is configured to enable wireless data communications between computing devices (not shown). In the present example, the wireless data communications enabled by the assembly 100 are conducted according to the Institute of Electrical and Electronics Engineers (IEEE) 802.11ad standard, also referred to as WiGig, which employs frequencies of about 57 GHz to about 66 GHz. As will be apparent, however, the assembly 100 may also enable wireless communications according to other suitable standards, employing other frequency bands. The assembly 100 can be integrated with a computing device, or in other examples, can be implemented as a discrete device that is removably connected to a computing device. In examples in which the assembly 100 is configured to be removably connected to a computing device, the assembly 100 includes a communications interface 104, such as a Universal Serial Bus (USB) port, configured to connect the remaining components of the assembly 100 to a host computing device (not shown).

The assembly 100 includes a primary board 108, which may also be referred to as a primary support. In the present example, the primary board 108 is a printed circuit board (PCB), for example fabricated with FR4 material, carrying either directly or via additional boards, the remaining components of the assembly 100. In particular, the primary board 108 carries, e.g. on an upper surface 110 thereof, the above-mentioned communications interface 104. The upper surface 110 is referred to as "upper" to distinguish from the opposing surface, to be discussed below, and does not indicate a required orientation of the assembly 100 in use.

The primary board 108 also carries, on the upper surface 110, a baseband controller 112. The baseband controller 112 is implemented as a discrete integrated circuit (IC) in the present example, such as a field-programmable gate array (FPGA). In other examples, the baseband controller 112 may be implemented as two or more discrete components. In further examples, the baseband controller 112 can be integrated within the primary board 108 (i.e. be defined within the conductive layers of the primary board 108) rather than carried on the upper surface 110.

In the present example, the baseband controller 112 is connected to the primary board 108 via any suitable surface-mount package, such as a ball-grid array (BGA) package that electrically couples the baseband controller 112 to signal paths (also referred to as leads, traces and the like) formed within the primary board 108 and connected to other components of the assembly 100. For example, the primary board 108 defines signal paths (not shown) between the baseband controller 112 and the communications interface 104. Via such signal paths, the baseband controller 112 transmits data received at the assembly 100 to the communications interface for delivery to a host computing device, and also receives data from the host computing device for wireless transmission by the assembly 100 to another computing device. Further, the primary board 108 defines additional signals paths extending between the baseband controller 112 and further components of the assembly 100, to be discussed below.

The assembly 100 also includes an antenna disposed on the upper surface 110, in the present example. In the present example, the upper surface 110 includes (e.g. as traces defined by a conductive layer of the primary board 108) three independently steerable antennae 116-1, 116-2, and 116-3 (referred to collectively as the antennae 116, and generically as an antenna 116). Each antenna 116 includes a phased array of printed (i.e. formed integrally with the primary board 108) antenna elements, such as double-sided dipole antenna elements, Yagi antenna elements, or the like. As illustrated in FIG. 1A, the antenna 116-1 and the antenna 116-2 each include three such elements, while the antenna 116-2 includes four elements. The antennae 116, as will now be apparent, are configured as end-fire antennae, having transmission and reception lobes extending substantially parallel to the plane of the upper surface 110. In other examples, the antennae 116 can be omitted, or a different number of antenna 116 can be deployed on the upper surface 110. In addition, the antenna 116 need not have the same number of elements as illustrated.

The antenna 116 are connected via an interposer 120 to a radio controller 124. More specifically, the interposer 120 is a discrete component mounted on the upper surface 110 via a suitable surface-mount package (e.g. BGA). The interposer 120 itself carries the radio controller 124, and contains signal paths (also referred to as feed lines) for connecting control ports of the radio controller 124 to the baseband controller 112, the elements of the antennae 116, and further antenna elements to be discussed in greater detail below. The radio controller 124 may, for example, be placed onto or into the interposer via a pin grid array or other suitable surface-mount package. The connections between the radio controller 124 and the baseband controller 112, as well as the connections between the radio controller 124 and the antennae 116 may be deployed as discussed in Applicant's co-pending U.S. patent application Ser. No. 15/668,025, the contents of which are incorporated herein by reference.

In general, the radio controller 124 includes a transmit and a receive port for connection, via the interposer 120 and traces defined by the primary board 108, to the baseband controller 112. The radio controller 124 also includes a plurality of antenna ports for connection, via the interposer 120, to corresponding contacts on the upper surface 110 of the primary board 108. Certain of the above-mentioned contacts connect to the elements of the antennae 116, while others of the above-mentioned contacts connect to additional antenna elements, to be discussed below.

Figure 1B:
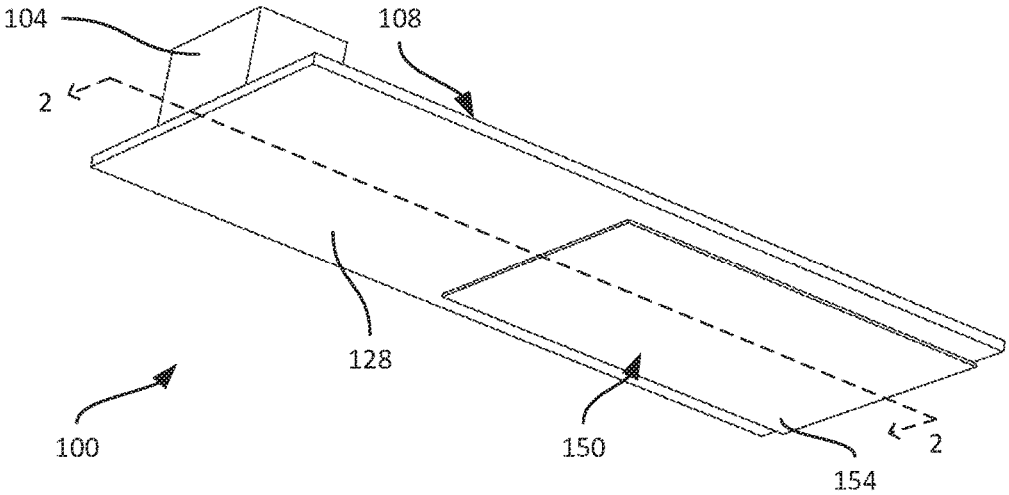

Turning to FIG. 1B, the primary board 108 also has a lower surface 128 opposite the upper surface 110. Connected to the lower surface 110 via a suitable surface-mount package (e.g. a BGA package, not visible in FIG. 1B) is a superstrate board 150, which includes an outer surface 154 (i.e. a surface facing away from the primary board 108) and an opposing inner surface (not visible in FIG. 1B) facing the primary board 108, and specifically, facing the lower surface 128 of the primary board 108. As will be seen below, the superstrate board 150 supports one or more phased array antennae.

Figure 2A:
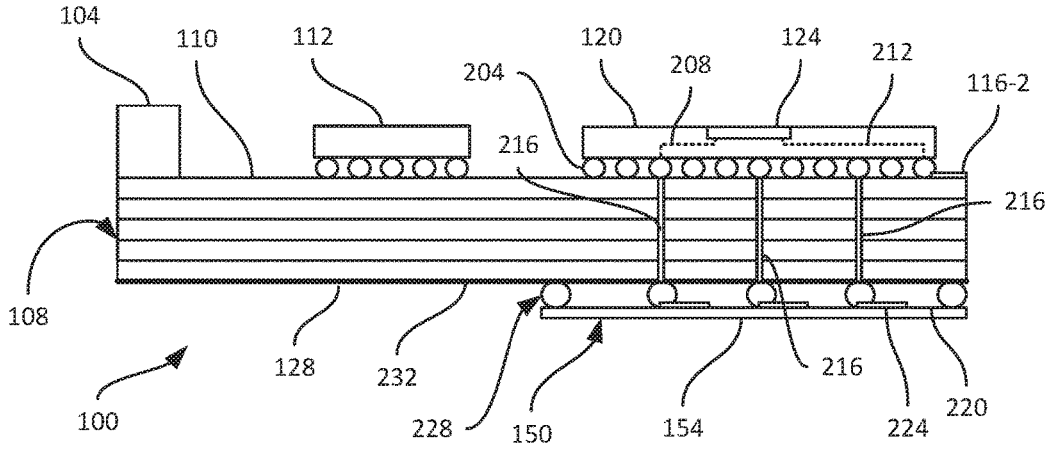
FIG. 2A depicts a cross-section of the system of FIG. 1.

Turning to FIG. 2A, the cross-section 2-2 indicated in FIG. 1B is illustrated. As seen in FIG. 2A, the interposer 120 is connected to the upper surface 110 via a surface-mount package 204, which in the present example is a BGA package. The interposer 120 contains a plurality of internal feed lines, examples 208 and 212 of which are shown in FIG. 2A, connecting control ports of the radio controller 124 to elements of the package 204 for electrical connection with control contacts on the upper surface 110, which will be illustrated in greater detail below. A portion of the control contacts on the upper surface 110 are configured to feed the elements of the antenna 116 (an element of the antenna 116-2, while a further portion of the control contacts on the upper surface 110 are connected to conduits 216 extending through the primary board 108 from the upper surface 110 to the lower surface 128. In particular, the conduits 216, which are preferably implemented as straight vias extending directly through the primary conduit 108, electrically connect the relevant control contacts on the upper surface 110 to a corresponding set of antenna contacts on the lower surface 128. That is, the antenna contacts on the lower surface 128 are preferably directly opposite the corresponding control contacts on the upper surface 110.

The superstrate board 150 includes, in addition to the outer surface 154 mentioned above, an inner surface 220 configured to face the lower surface 128 of the primary board 108 when assembled. On the inner surface 220, the superstrate board 150 bears a phased array of antenna elements 224 (three of which are visible in FIG. 2A) that in the present example are printed patch elements. As seen in FIG. 2A, the superstrate board 150 is connected to the primary board 108 by a surface-mount package 228, which in the present example is a BGA package. The package 228 includes connection elements connecting the above-mentioned antenna contacts on the lower surface 128 directly to the patch elements 224. The package 228 may also include additional connection elements (such as the left-most and right-most balls shown in FIG. 2A) for structural stability.

The primary board 108 also includes an antenna ground plane 232. In the example shown in FIG. 2A, the antenna ground plane 232 is defined on the outermost conductive layer of the primary board 108 and is thus coincident with the lower surface 128. The superstrate board 150 is implemented as a single-layer PCB, for example fabricated with a high-performance material such as a 0.2 mm thick layer of material having a dielectric constant of about 3.3. Various other suitable materials will also occur to those skilled in the art for the superstrate board 150. Of particular note, the superstrate board 150 does not include a ground plane. Further, the superstrate board 150 does not require an internal feed network as the package 228 connects the primary board 108 directly to the patch elements 224. The superstrate board 150 therefore need only support the patch elements 224, and provides a degree of physical protection to the patch elements 224.

As will now be apparent, because the superstrate board 150 lacks a ground plane, the antenna ground plane 232 acts as the ground plane for the antenna defined by the patch elements 224. The patch elements 224, thus radiate away from the primary board 108, through the superstrate board 150. The package 228, and the air between the elements (i.e. solder balls in the present example) of the package 228, therefore provide a substrate for the patch elements 224.

Figure 2B:
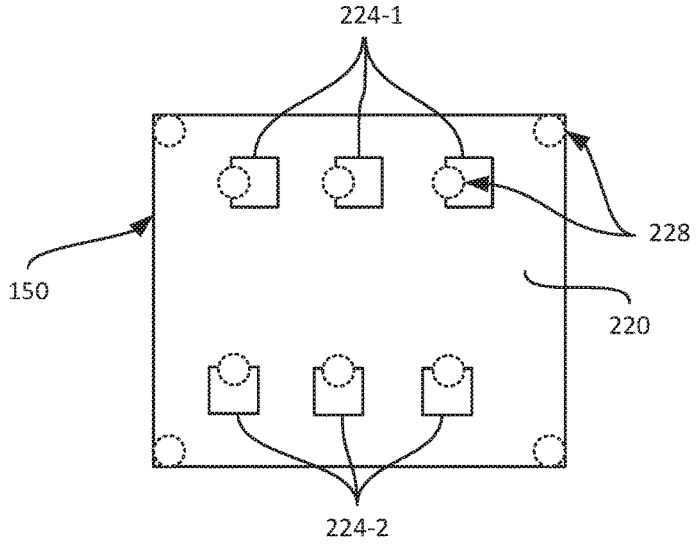
FIG. 2B depicts a top view of the inner surface of a superstrate board of the system of FIG. 2A.

FIG. 2B illustrates the inner surface 220 of the superstrate board 150, such that the patch elements 224 are fully visible. In particular, in the present embodiment two sets of patch elements 224, labelled as arrays 224-1 and 224-2, are implemented on the inner surface 220. The array 224-1 (visible in FIG. 2A) is horizontally polarized, while the array 224-2 is vertically polarized. In other embodiments, the arrays 224 may have reversed polarizations, or may have the same polarization. Further, in some embodiments the patch elements 224 may form a single phased array antenna instead of two. In further embodiments, still, more than two phased arrays can be implemented on the inner surface 220, with more or fewer patch elements than the arrays 124 shown in FIG. 2B.

Figure 3A:
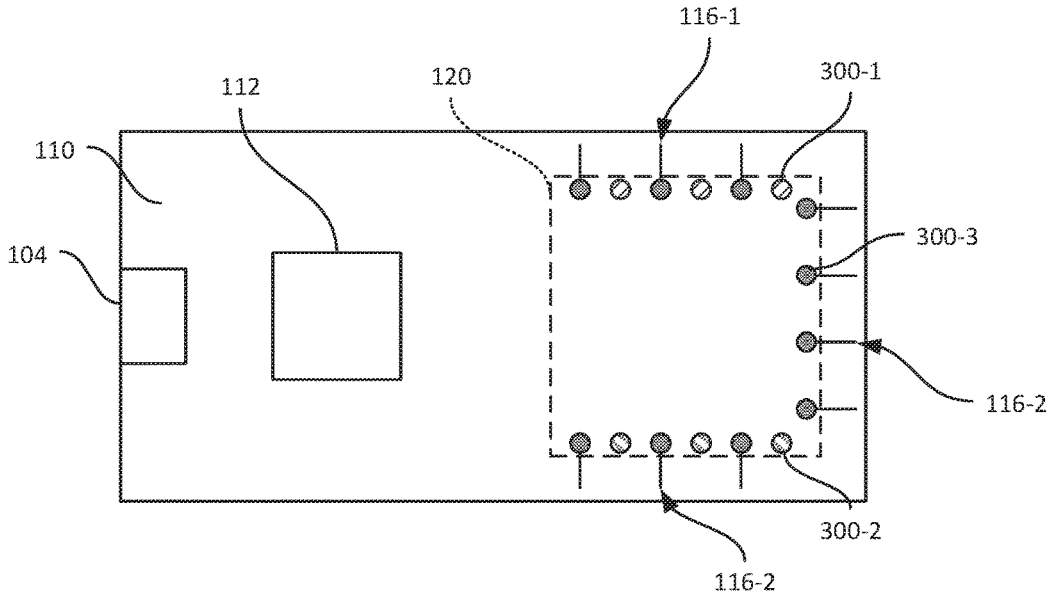
FIGS. 3A and 3B depict control and antenna contacts in the system of FIG. 2A.
Figure 3B:
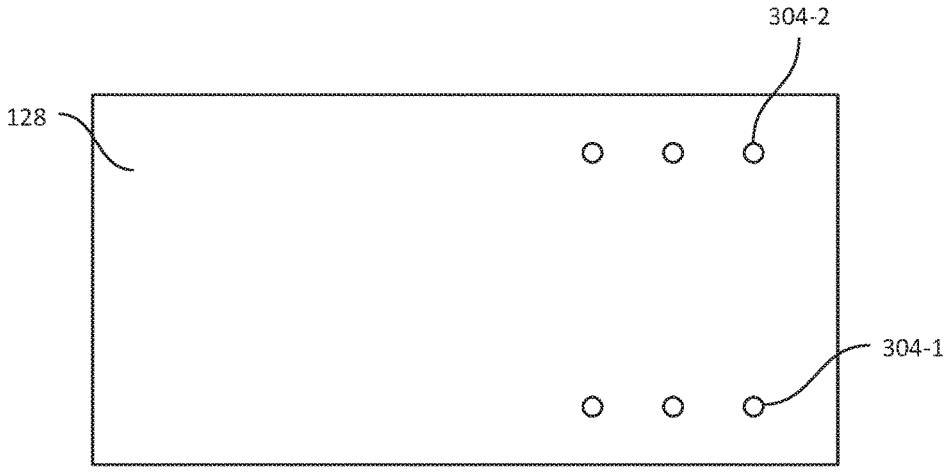

Turning to FIGS. 3A and 3B, the above-mentioned contacts are shown in greater detail. In particular, several sets of control contacts 300 are shown on the upper surface 110. In the present example, the upper surface 110 includes sixteen control contacts, corresponding to sixteen ports of the radio controller 124 (to which the contacts 300 are connected via the interposer 120, which is omitted in FIG. 3A but whose position is shown in dashed lines). In the present example, a first set 300-1 of the control contacts corresponds to a first set of antenna contacts 304-1 on the lower surface 128 as shown in FIG. 3B. The set 300-1 of control contacts, as will now be apparent, are configured for connection to the patches 224-1 via the package 228. The upper surface also includes a second set 300-2 of control contacts, which are connected (by a corresponding set of the conduits 216) to a second set 304-2 of antenna contacts on the lower surface, which are configured for connection to the patches 224-2 via the package 228. The upper surface 110 also includes a third set 300-3 of antenna contacts, which are not connected to conduits 216, but which instead feed the antennae 116 on the upper surface 110 itself.

Figure 4A:
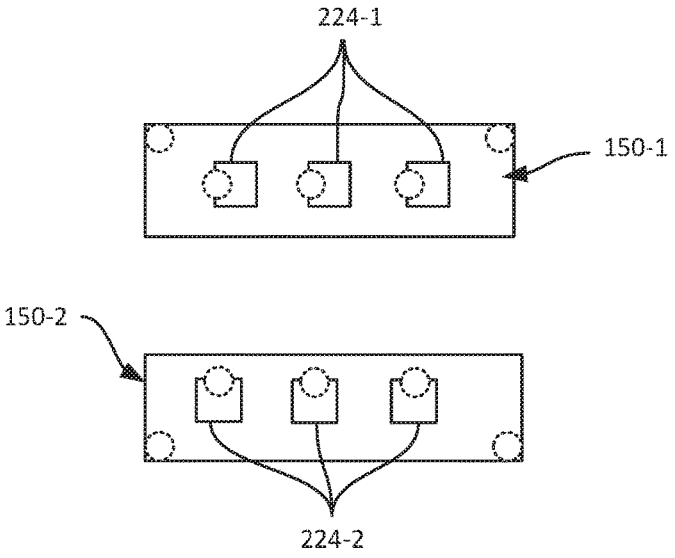
FIG. 4A shows a variation of the superstrate of FIG. 2B.

Further variations to the above systems are contemplated. For example, turning to FIG. 4A, the superstrate 150 is replaced with a pair of superstrates 150-1 and 150-2, each carrying a respective set of the patches 224. The space between the superstrates 150-1 and 150-2, when they are connected to the lower surface 128 by respective surface-mount packages may be employed to support additional components for the primary board 108 (e.g. capacitors, a crystal oscillator and the like).

Figure 4B:
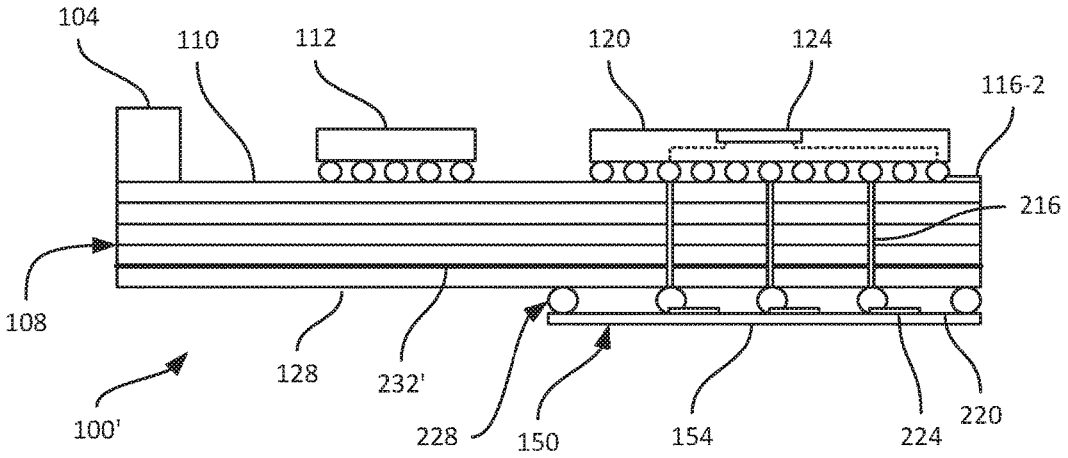
FIGS. 4B, 5A, 5B and 6 show variations of the system of FIG. 2A.

Turning to FIG. 4B, a further variation is shown, illustrated as the system 100' in which a modified antenna ground plane 232' is placed one layer into the primary board 108 instead of directly on the lower surface 128. The arrangement shown in FIG. 4B places a greater distance between the ground plane 232' and the patches 224. As will be apparent to those skilled in the art, the greater distance between the ground 232' and the patches 224 increases the operational bandwidth (i.e, the range of frequencies) of the patches 224. When the primary board 108 is fabricated with a material such as FR4, the placement of the ground plane 232' as shown may lead to a degree of transmission losses, due to the introduction of FR4 into the antenna substrate for the patches 224. In other embodiments, the bandwidth of the patches 224 may be adjusted by adjusting the height of the elements of the package 228.

Figure 5A:
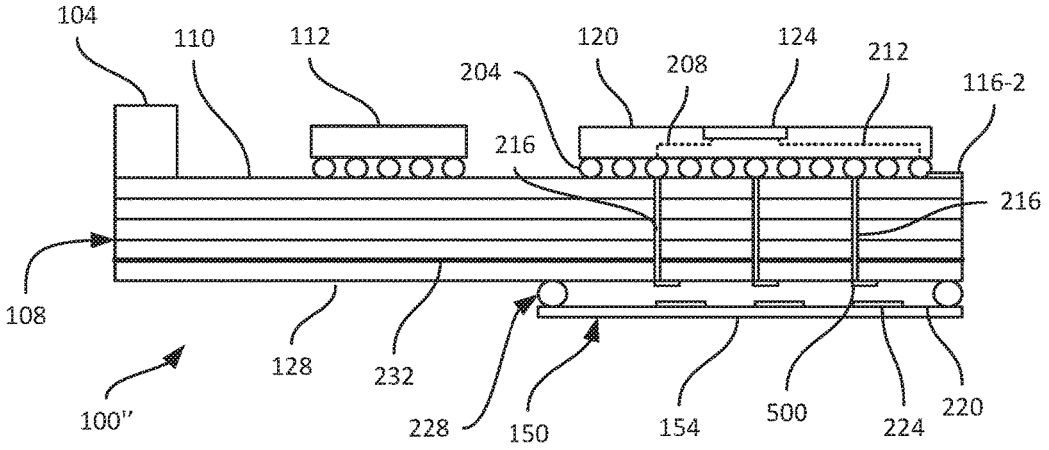
Figure 5B:
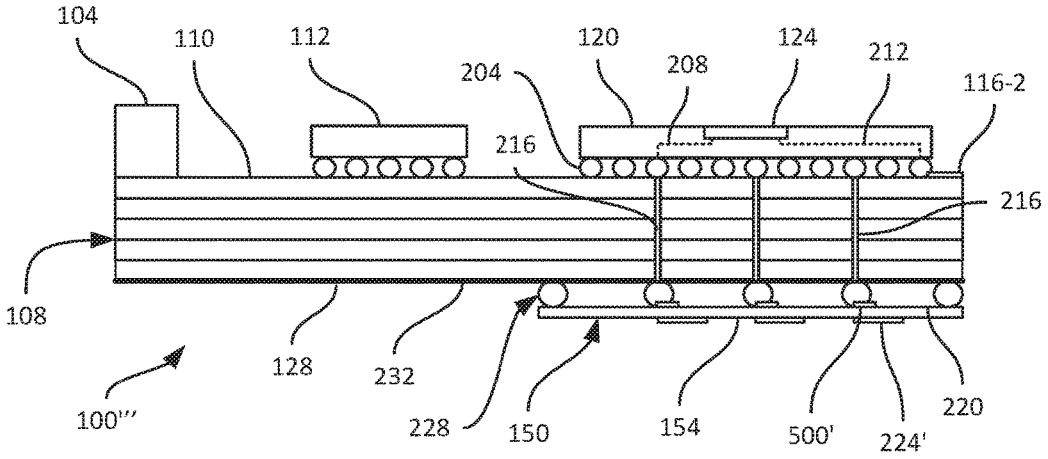
Figure 6:
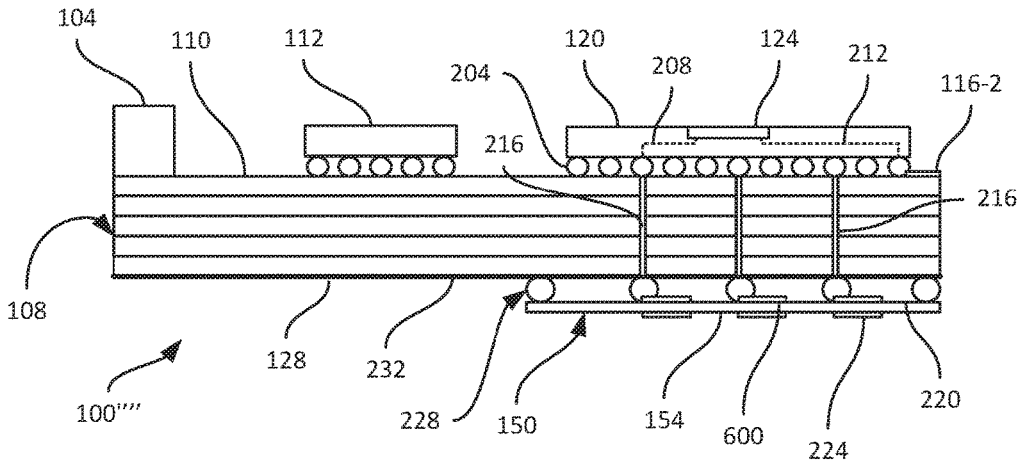

Turning to FIG. 5A, a further variation 100" is shown in which the patches 224 are not contacted directly by the package 228. Instead, the elements of the package 228 are employed solely for grounding and structural support. The patches 224 are fed capacitively, by feeder patches 500 placed on the lower surface 128 of the primary board 108. FIG. 5B illustrates a further variation 100''', in which patches 224' are placed on the outer surface 154 of the superstrate board 150 rather than on the inner surface, and are fed capacitively by feeder patches on the inner surface 220. FIG. 6 illustrates a further variation, including the patches 224' on the outer surface 154 and additional patches 600 on the inner surface 220 that are connected directly to the antenna contacts on the lower surface 128 and both radiate and feed the patches 224'.

The scope of the claims should not be limited by the embodiments set forth in the above examples, but should be given the broadest interpretation consistent with the description as a whole.

The invention claimed is:

1. A wireless communications assembly, comprising:

a primary board including:

(i) an upper surface bearing a radio controller, and defining a set of control contacts for connection to respective ports of the radio controller;

(ii) a lower surface opposite the upper surface, the lower surface defining a plurality of antenna contacts;

(iii) a plurality of conduits extending through the primary board from the antenna contacts to the control contacts; and (iv) an antenna ground plane;

a superstrate board including:

(i) an inner surface facing the lower surface of the primary board;

(ii) an outer surface opposite the inner surface;

(iii) a phased array of antenna elements disposed on one of the inner surface and the outer surface; and a surface-mount package between the lower surface and the inner surface for connecting a subset of the antenna contacts to the antenna elements and to provide a substrate between the antenna elements and the antenna ground layer.

2. The wireless communications assembly of claim 1, further comprising:

a baseband controller on the upper surface of the primary board.

3. The wireless communications assembly of claim 2, further comprising:

a communications interface on the upper surface of the primary board, connected to the baseband controller.

4. The wireless communications assembly of claim 1, wherein the antenna ground plane is on the lower surface of the primary board.

5. The wireless communications assembly of claim 1, wherein the antenna elements are patches.

6. The wireless communications assembly of claim 5, wherein the patches are disposed on the inner surface of the superstrate board.

7. The wireless communications assembly of claim 6, wherein the surface-mount package directly contacts the patches.

8. The wireless communications assembly of claim 1, wherein the antenna elements include a first phased array having a first polarization, and a second phased array having a second polarization.

9. The wireless communications assembly of claim 1, wherein the superstrate board is a single-layer printed circuit board (PCB).

10. The wireless communications assembly of claim 1, wherein the surface-mount package is a ball-grid array (BGA) package.

11. The wireless communications assembly of claim 1, further comprising:

an interposer on the upper surface of the primary board, configured to connect the ports of the radio controller to the control contacts.

12. The wireless communications assembly of claim 1, further comprising:

an additional phased array on the upper surface of the primary board.

* * * * *